United States Patent [19]

Davignon

[11] 4,293,142

[45] Oct. 6, 1981

[54] VIBRATION DAMPED SKI

[75] Inventor: Alan J. Davignon, Vashon, Wash.

[73] Assignee: K-2 Corporation, Vashon Island, Wash.

[21] Appl. No.: 57,576

[22] Filed: Jul. 16, 1979

[51] Int. Cl.[3] ..... A63C 5/12

[52] U.S. Cl. ..... 280/610

[58] Field of Search ..... 280/610, 602, 601; 9/310 A

[56] References Cited

U.S. PATENT DOCUMENTS

| | | | |
|---|---|---|---|
| 2,995,379 | 8/1961 | Head | 280/610 |
| 3,372,943 | 3/1968 | Grossauer | 280/610 |
| 3,393,918 | 7/1968 | Styka | 280/610 |
| 3,398,968 | 8/1968 | Mutzhas | 280/602 |
| 3,414,279 | 12/1968 | Allain | 280/610 |
| 3,537,717 | 11/1970 | Caldwell | 280/602 |
| 3,612,556 | 10/1971 | Seawell | 280/610 |
| 3,635,482 | 1/1972 | Holman | 280/610 |
| 3,635,483 | 1/1972 | Barriball et al. | 280/610 |
| 3,698,731 | 10/1972 | Jost et al. | 280/610 |
| 3,844,576 | 10/1974 | Schultes | 280/610 |
| 3,861,699 | 1/1975 | Molnar | 280/610 |
| 3,901,522 | 8/1975 | Boehm | 280/610 |
| 4,071,264 | 1/1978 | Legrand et al. | 280/610 |

FOREIGN PATENT DOCUMENTS

| | | | |
|---|---|---|---|
| 680647 | 2/1964 | Canada | 280/610 |
| 1961487 | 7/1970 | Fed. Rep. of Germany | 280/610 |
| 1304880 | 8/1962 | France | 280/602 |
| 459026 | 8/1968 | Switzerland | 280/602 |
| 466980 | 2/1969 | Switzerland | 280/610 |

*Primary Examiner*—John P. Silverstrim
*Assistant Examiner*—Milton L. Smith
*Attorney, Agent, or Firm*—Graybeal & Uhlir

[57] ABSTRACT

The core of a ski includes a layer of viscoelastic material positioned at the neutral axis thereof at every point therealong. An upper constraining layer is positioned above the viscoelastic material, and a lower constraining layer is positioned below the viscoelastic material. The core also includes an upper layer of low modulus of elasticity material placed above the upper constraining layer and a lower layer of low modulus of elasticity material placed below the lower constraining layer. A torsion box member constructed of high modulus of elasticity material surrounds the core to serve as the primary load carrying structural member of the ski. A cosmetic top layer is disposed above the box member while a bottom or running surface is disposed below the box member.

6 Claims, 6 Drawing Figures

VIBRATION DAMPED SKI

BACKGROUND OF THE INVENTION

1. Field of the Invention

The present invention relates to skis, and in particular to a new vibration damped, composite snow ski.

2. Description of the Prior Art

Many recently designed skis have been constructed from a composition of several types of materials in an attempt to maximize desired characteristics such as lightness of weight, flexibility, and durability. The different materials have been positioned at various cross-sectional locations in the ski to attempt to influence these characteristics advantageously. Ski designers have recognized that a highly vibration damped ski has desirable characteristics. Efforts have even been made to construct skis which dampen the high frequency vibration or flutter that occurs during high speeds and on icy slopes thus increasing the proportion of the time the ski is actually in contact with the snow. The larger the percentage of the time a ski in contact with the snow, the easier it is to control, especially when turning. In the past, the search for means to damp vibration of a ski has been focused upon multi-layer types of skis which have an inherent damping capability as compared with skis employing an internal structural torsion box design. Torsion box skis are formed by wet wrapping fiberglass around the core of a ski. The use of a wet wrapped box, with its structural fiberglass side walls, produces a more vibration prone ski than the multi layered type ski, the resin side walls of which function primarily to seal the ski core rather than structurally strengthen the ski.

One type of known vibration damping ski incorporates a core of foamed plastic material. An example of this type of ski is disclosed in Grossauer, U.S. Pat. No. 3,372,943, wherein a foam core is encased within a top and bottom metal cover sheet and within side edge strips made from resilient material. The foamed plastic core material is said to partially dampen the resiliency of the skis.

Another ski utilizing foamed plastic in the core region is disclosed in Molnar, U.S. Pat. No. 3,861,699. In Molnar the core of the ski consists of a honeycomb structure having longitudinal cavities which are filled with foamed plastic. The honeycomb portion of the core is made from fiber reinforced, resinous plastic. The core is bonded to the bottom surface of the ski through the use of an elastic bonding medium such as an epoxy or phenolic. The particular bonding medium used is said to determine the dampening characteristics of the ski.

A second type of vibration damped ski, as disclosed by Allain, U.S. Pat. No. 3,414,279, utilizes an antivibratory member constructed from rigid plastic material formed in the shape of a downwardly open channel member. Spongy elastic strips of gummed neoprene material are used to attach the flanges of the antivibratory member to the lower portion of the ski.

A third type of vibration damped multi-layer ski utilizes viscoelastic material disclosed by Schultes, U.S. Pat. No. 3,844,576 and Boehm, U.S. Pat. No. 3,901,522. In the Schultes '576 patent, the ski includes a stretch resistant constraining layer of metal which is imbedded in a thicker and wider layer of viscoelastic material, thus isolating the constraining layer from the rest of the ski. The viscoelastic layer is positioned between the central core of the ski and the bottom surface of the ski thereby ensuring that the viscoelastic layer is positioned as far as possible from the neutral axis of the ski.

The ski in the Boehm '522 patent is constructed identically to the ski shown in the Schultes '576 patent with the exception that the constraining member of the vibration damping laminate is sandwiched below a layer of viscoelastic material and above a layer of rubber. The layer of rubber isolates the constraining layer from the bottom or running layer of the ski. The viscoelastic layer in turn isolates the constraining layer from the core and upper surface of the ski. As in the '576 patent, the constraining layer is substantially narrower than the width of the viscoelastic layer and the vibration damping laminate is again positioned as far from the neutral axis of the ski as possible.

Another example of a type of ski utilizing viscoelastic material is disclosed in Caldwell, U.S. Pat. No. 3,537,717, wherein two parallel strips of viscoelastic material are positioned longitudinally along the top surface of the ski between the bindings and tip of the ski. A constraining layer of aluminum, stainless steel or fiberglass material is positioned on top of each dampening strip.

A fourth type of ski incorporating viscoelastic material is disclosed in Head, Canadian Pat. No. 680,647. This particular ski is said to permit its bending to be independently varied from its torsional rigidity characteristics. The ski essentially includes an upper laminate, a central core and a bottom running surface. The upper laminate has a metallic top facing, an intermediate layer of rubber, and a metallic lower layer. This particular laminate construction is said to reduce the overall sheer stiffness of the ski, while not affecting the overall bending stiffness of the ski, thereby increasing the ability of the ski to absorb vibration.

Also of interest are Legrand et al., U.S. Pat. No. 4,071,264, which discloses a ski constructed from a reinforced core formed from synthetic resinous material, and Seawall, U.S. Pat. No. 3,612,556 which discloses sandwiching a longitudinal strip of neoprene material below an aluminum plate and above the ground-engaging bottom strip of a ski. Holman, U.S. Pat. No. 3,635,482, discloses a ski which has a polyurethane foam core interposed between upper and lower sheets of glass reinforced thermoplastic material.

SUMMARY OF THE INVENTION

The present invention relates to a novel vibration damped snow ski which, in basic form, is composed of a vibration damping core disposed between the top and bottom surface of the ski. The core includes a layer of viscoelastic material positioned at the neutral axis of the ski. As part of the core construction, an upper constraining layer of rigid, high modulus of elasticity material is disposed on top of the viscoelastic material and a lower constraining layer of rigid, high modulus of elasticity material is disposed beneath the viscoelastic material. Additionally, the core includes an upper layer of lightweight, low modulus of elasticity material positioned above the upper constraining layer and a lower layer of lightweight, low modulus of elasticity material positioned below the lower constraining layer. In the disclosed embodiment, the layered core is surrounded by a box member constructed of a high modulus of elasticity material, which box member includes an upper wall disposed between the layered core and the top surface of the ski, a lower wall disposed between the layered core and the bottom surface of the ski, and side walls disposed outwardly adjacent to the side walls of the core. In the preferred embodiment the box member is formed of fiberglass and resin which is wet wrapped around the layered core to form a torsion box.

In a ski constructed according to the present invention, the viscoelastic material will deform in shear under the shear stress created by each upward and downward flexure of the ski. Thus, the viscoelastic material dampens ski vibrations by transforming kinetic vibrational energy into heat energy. Since the maximum shear stress and strain occur at the neutral axis of the ski, placing the shear damping viscoelastic material at this location maximizes the damping of the ski vibrations. Furthermore, high modulus of elasticity material by being placed at the upper and lower surfaces of the thin viscoelastic material, and thus effectively at the neutral axis of the ski, distributes or propagates the shear stress and strain throughout the viscoelastic material while not increasing the stiffness of the ski.

It is a primary object of the present invention to provide a ski which is damped against high frequency vibrations through the placement of a viscoelastic, shear damping material at the neutral axis of the ski.

Another object of the present invention is to provide a ski which is not only capable of damping high frequency vibrations, but is also strong enough to withstand the rugged use encountered during skiing.

Still another object is to provide a ski including a load bearing box construction having improved vibrational damping characteristics.

One more object is to provide a ski having a vibration damping laminate composed of a viscoelastic material sandwiched between materials having a high modulus of elasticity and located at the neutral axis of the ski.

Another object is to provide a ski having a vibration damping laminate which extends throughout the full width and length of the core of the ski.

Other objects and advantages of the present invention will be set forth in and understood from the following detailed description of a preferred embodiment of the invention, taken in connection with the accompanying drawings.

DESCRIPTION OF THE PREFERRED EMBODIMENT

Figure 1:
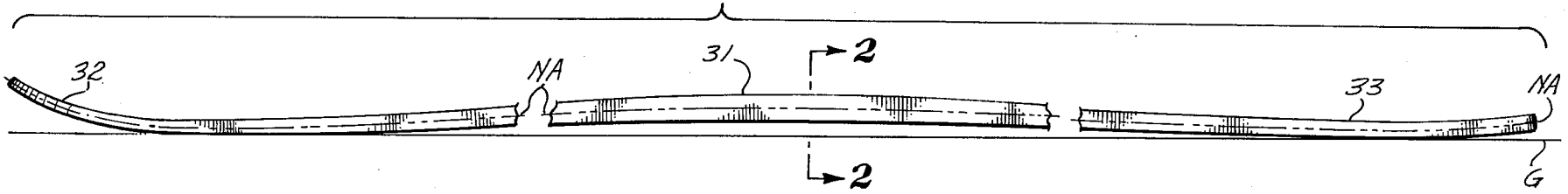
FIG. 1 is a fragmentary side elevational view of one typical embodiment of the present invention.
Figure 3:
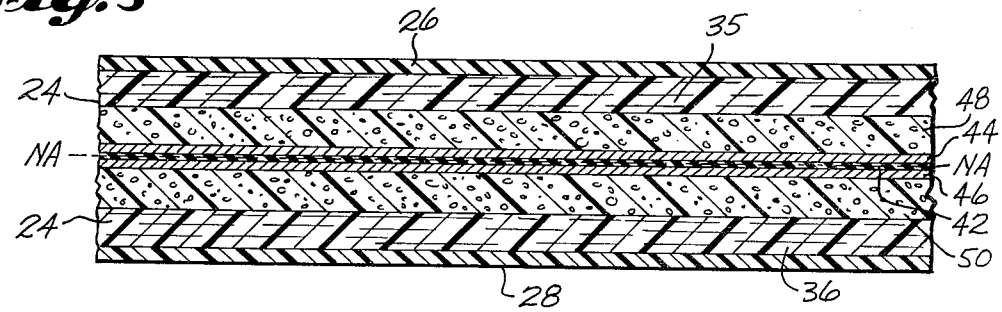
FIG. 3 is an enlarged, fragmentary cross-sectional view of the ski shown in FIG. 2 taken substantially along lines 3—3 thereof.

Referring initially to FIGS. 2 through 5, shown in cross-sectional views is a typical vibration damped ski constructed according to the present invention and which is also the best mode of the invention currently known to applicant. Ski 20 in the preferred form illustrated includes a layered central core 22 which is surrounded by a torsion box member or structure 24. A cosmetic top layer or surface 26 is placed above box member 24, while a base or bottom surface 28 is placed below box member 24. Ski 20 also has conventional metal edges 30 disposed outwardly of bottom surface 28 to form the longitudinal running edges of the ski. Furthermore, as is common in current ski design, ski 20 is constructed thicker in the region 31 intermediate tip or shovel portion 32 and tail portion 33 (FIG. 1), and is formed with a slight camber. More specifically, top layer 26 extends the full length and width of ski 20 and is preferably composed of a tough, durable plastic material, such as Urethane. Top layer 20 functions to protect box member 24 from cuts, scratches or other damage due to falls and other mishaps which commonly occur during skiing. To enhance the appearance of ski 20, top layer 26 is normally designed and colored as desired and may bear the name of the ski or the ski manufacturer.

Base surface 28 is preferably composed of polyethylene material which is commonly used in snow skis. As is also well known in the design of snow skis, edges 30 are preferably constructed of a continuous length of steel having an L-shaped cross section. The horizontal leg 34 of each edge 30 is sandwiched between box member 24 and the base surface 28 thereby securely locking each edge 30 in place.

Figure 2:
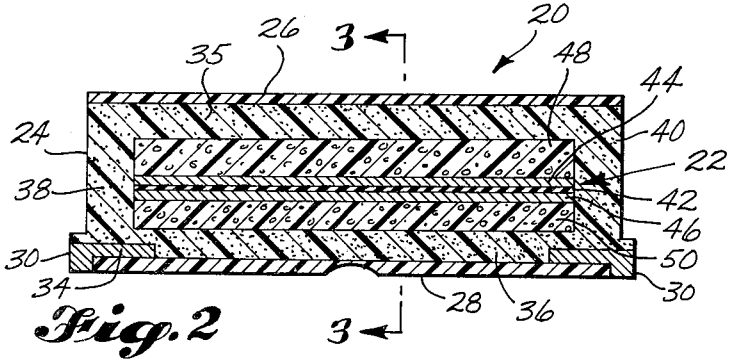
FIG. 2 is an enlarged cross-sectional view of the ski shown in FIG. 1 taken substantially along line 2—2 thereof.

Now referring specifically to FIG. 2, box member 24 is shown to have a hollow, rectangular, cross-sectional shape which encases core 22. Box member 24 is composed of an upper wall 35, a lower wall 36 and side walls 38 and 40. Preferably, box member 24 is constructed from a high modulus of elasticity material, such as fiberlgass which has been wet wrapped around the core 22 and soaked with resin. The hollow, rectangular shape of box member 24 provides ski 20 with substantial structural integrity without also adding an undesirable amount of weight to the ski. The use of torsion box 24 produces a "lively" ski which is highly responsive to forces imparted on the ski during use. As a result, however, skis made according to this design also have tended in the past to exhibit a greater degree of undesirable high frequency vibration than have skis employing a layered design without a torsion box.

Again referring to FIG. 2, core 22 is illustrated as including a thin layer of viscoelastic material 42 which is disposed along the neutral axis NA of ski 20 to extend the full width and length of core 22. Core 22 also includes a thin, upper constraining layer 44 of rigid material that is bonded to the upper surface of viscoelastic layer 42. Correspondingly, a lower constraining layer 46 of thin rigid material is bonded to the lower surface of viscoelastic layer 42. Core 42 further includes an upper core layer 48 which is bonded to the upper surface of upper constraining layer 44, and a lower core layer 50 which is bonded to the lower surface of lower constraining layer 46. Ideally both upper core layer 48 and lower core layer 50 are composed of lightweight, low modulus of elasticity material, such as wood or plastic foam and all of the different layers 42, 44, 46, 48, and 50 which compose core 22 are of the same length and width. Also, preferably the upper and lower constraining layers 44 and 46, respectively, are composed of the same resin used in the formulation of plastic foam from which upper and lower core layers 48 and 50, respectively, are constructed. Ideally the resin should be of a brittle type so that it has a modulus of elasticity significantly greater than that of core layers 48 and 50 to thereby effectively propogate shear strains between the viscoelastic material 42 and the rest of ski 20. Constraining layers 44 and 46 can also be constructed from layers of other high modulus of elasticity materials, such as aluminum, steel, graphite, fiberglass, or Kevlar, bonded to viscoelastic material 42 and their corresponding core layers 48 and 50, respectively. One drawback of using these materials is that they add more weight to ski 20 compared to the use of resin alone to form constraining layers 44 and 46.

When an elongate beam structure such as a ski is flexed downwardly so that the ends of the ski are above the center of the ski, the fibers or elements in the upper portion of the ski are longitudinally compressed by flexural compressive stresses while the fibers or elements in the lower portion of the ski are longitudinally stretched or extended by flexural tensile stresses. The compressive stresses and strains in the upper portion of the ski vary along the thickness of the ski from a maximum at the upper surface of the ski to theoretically a minimum of zero at the neutral axis of the ski. Correspondingly, the tensile stresses and strains in the fibers of the lower portion of the ski also vary along the thickness of the ski to a theoretical minimum of zero at the neutral axis of the ski.

Theoretically considering a ski to be composed of a solid beam constructed by gluing together an infinite number of longitudinally extending layers, the compressive stresses and strains acting on the layers varies in each layer from a maximum at the uppermost layer to zero magnitude at the neutral axis of the ski. Likewise, the tensile stresses and strains acting on the lower layers of the ski varies in each theoretical layer from a maximum at the bottom layer of the ski to a theoretical minimum of zero at the neutral axis of the ski.

It can be appreciated that if this theoretical ski is flexed upwardly, instead of downwardly as described above, so that the ends of the ski are below the center of the ski, the compressive stress and strain would be at a maximum at the bottom layer of the ski while the tensile stress and strain would be a maximum at the top layer of the ski. Thus, with every vibration cycle, the layers of the ski are alternatively longitudinally compressed and stretched by flexural compressive and tensile stresses, respectively.

Furthermore, the difference in magnitude of the compressive or tensile stresses and strains that occur in each adjacent layer of the ski tends to bias the layers to slip longitudinally relative to each other. However, since all of the layers are glued together so that little relative longitudinal movement is permitted between layers, it can be appreciated that a longitudinally extending shear stress will occur between each of the theoretical layers of the ski.

Now theoretically considering a ski constructed from an infinite number of individual layers which are stacked on top of each other but not glued or otherwise fastened together, downward ski flexure, i.e. so that the ends of the ski are above the center of the ski, would cause each layer to actually slip longitudinally relative to adjacent layers. As a result of this slippage, the ends of each layer would be staggered relative to each other. This same type of slippage can be observed by bending a deck of cards and then noting the relative position of the ends of the cards with respect to each other. The fact that a solid beam formed by theoretically gluing an infinite number of layers together, as discussed above, does not exhibit this relative longitudinal movement, indicates the presence of the shearing stresses on longitudinal planes of the beam.

It is known that the maximum shear stress in such a solid beam, and thus the maximum shear strain, exists along the netural axis of the beam. The shear stress decreases along the depth of the beam from a maximum magnitude at the neutral axis of the beam to zero at the upper and lower surfaces of the beam.

Applying the principles discussed above to ski 20 and assuming that the ski is flexed such that the tip 32 and tail 33 extend upwardly of intermediate region 31, shear stresses and strains occur in the portion of the ski both above and below the neutral axis NA. However, as shown in somewhat exaggerated form in the ski section of FIG. 4, viscoelastic layer 42, which is located at the neutral axis NA of ski 20 along the entire length of core 22, permits upper constraining layer 44 to slip longitudinally with respect to lower constraining layer 46. As a result, the end portions of upper constraining layer 44 move longitudinally beyond the end portions of lower constraining layer 46. When ski 20 is in the unflexed condition shown in FIG. 3, no flexural shear stresses or strains exist in ski 20, and thus the ends of upper constraining layer 44 and lower constraining layer 46 are positioned vertically adjacent each other.

Figure 5:
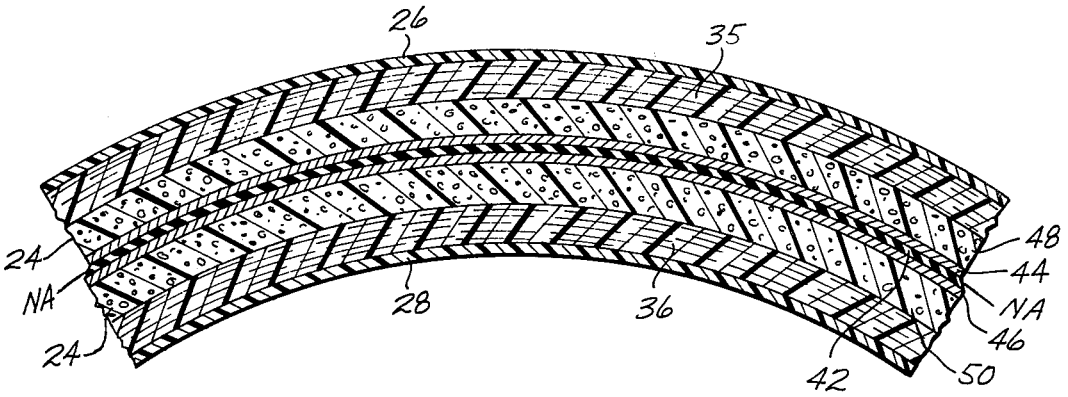
FIG. 5 is a view similar to FIG. 3; however with the ski flexed upwardly; and, FIG. 6 is a cross-sectional view similar to FIG. 2 of another typical embodiment of the present invention.

If ski 20 is flexed upwardly, so that tip 32 and tail 33 lie below intermediate region 31, shear stresses and strains are induced along longitudinal planes of ski 20. However, as illustrated in FIG. 5, the presence of viscoelastic layer 42 as the neutral axis NA of ski 20 permits the upper constraining layer 44 to slip relative to lower constraining layer 46. The relative slippage of upper contraining layer 44 with respect to lower constraining layer 46 results in the end portions of lower constraining layer 46 moving longitudinally beyond the corresponding end portions of upper constraining layer 44.

The above-described relative movement of upper constraining layer 44 with respect to lower constraining layer 46 occurs with each flexing cycle of ski 20. Thus, in accord with the present invention, it has been found that by sandwiching a material having shear damping capabilities, such as viscoelastic material 42, between upper and lower constraining layers 44 and 46, respectively, much of the high frequency vibration of ski 20 can be effectively and efficiently damped. Furthermore, since the maximum shear strain occurs at the neutral axis of a composite structure such as ski 20, the placing of viscoelastic material 44 precisely at the neutral axis NA of ski 20 ensures that efficient and maximum vibration damping will occur.

Most structural materials, at least when initially loaded, exhibit a linear relationship between stress and strain, and so are said to be linearly elastic. This linear relationship between stress and strain can be expressed by the equation: $\delta = E \times \epsilon$. $\delta$ represents stress, $\epsilon$ represents strain and E represents a constant proportionality known as the modulus of elasticity for the material. On the other hand, viscous materials exhibit a rate of deformation or strain which is proportional to the rate of applied stress. This relationship can be expressed by the equation: $\delta = \eta(d\epsilon/dt)$. $\delta$ represents stress and $d\epsilon/dt$ represents strain rate. $\eta$ is a constant proportionality known as the coefficient of viscosity. A viscoelastic material exhibits a behavior which is a combination of these elastic and viscous cases.

Figure 4:
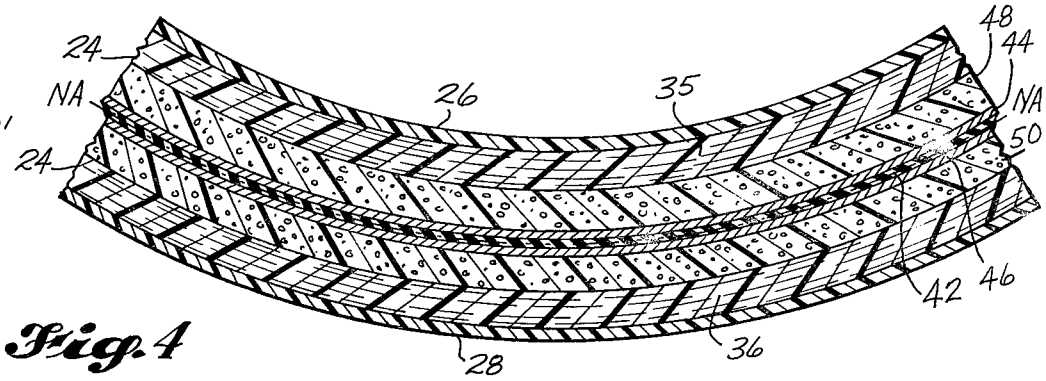
FIG. 4 is a view similar to FIG. 3 illustrating the relative position of the ski components with the ski flexed downwardly.

In operation, as ski 20 flexes, viscoelastic layer 42 is forced to undergo shearing strains as shown in FIGS. 4 and 5. This shear deformation of viscoelastic material 42 dissipates the kinetic vibrational energy of ski 20 by transforming it into heat energy. Furthermore, the use of rigid constraining layers 44 and 46 adjacent to viscoelastic material 42 ensures that the maximum strain occurs within such viscoelastic material 42 thereby producing the maximum dissipation of kinetic vibrational energy.

In preferred form, viscoelastic layer 42 is composed of a material sold under the trade name DYAD, which is manufactured by the Sound Coat Company, Inc. of Brooklyn, New York. DYAD has a density of 69 lbs. per cubic foot, a durometer hardness of 67 Shore A, a brittle point of minus 20 degrees Fahrenheit, a tensile strength of 2,400 lbs. per square inch and has the capability of being elongated to 425% of its nominal length. It has been applicant's experience that use of this material for viscoelastic layer 42 significantly reduces high frequency ski vibrations in the 20 to 100 hertz range. Furthermore, applicant has found that this material becomes more effective as the frequency of vibration of ski 20 increases.

Ski 20 is typically manufactured by starting initially with core 22 which has been assembled by first bonding viscoelastic layer 42 to upper and lower core layers 48 and 50 with the same resin used to form the core layers. The resin also serves as the constraining layers 44 and 46. At this state of construction, upper and lower core layers 48 and 50, respectively, are rectangular in shape. To ensure that the viscoelastic layer 42 is properly positioned along the entire length of ski 20, the bottom surface of lower core layer 50 is milled to a predetermined profile shape generally corresponding to that which would constitute the shape of the portion of ski 20 located above neutral axis NA, as shown in FIG. 1, before the camber had been formed in ski 20. Next, core 22 is turned over so that core upper layer 48 can also be milled to a predetermined profile shape corresponding to what would constitute the shape of the portion of ski 20 located below neutral axis NA, as shown in FIG. 1, before the camber had been placed in ski 20. The location of the neutral axis NA of ski 20 does not necessarily correspond to the geometric center of the ski but its location varies with the types of material used to construct ski 20, the relative placement of these various materials through the thickness of the ski and the thicknesses of these materials. Nevertheless, for a particular composite structure, such as ski 20, the location of the neutral axis NA can be calculated by well known methods.

After core 22 has been milled, it is preferably "wet" wrapped with layers of fiberglass material which have been impregnated with a thermo-setting resin. When cured, these fiberglass layers comprise box member 24. After being wrapped with the fiberglass, wetted core 22 is placed together with a preformed shovel tip, edges 30, bottom layer 28, and top layer 26 within a shaped mold and heat and pressure are applied thereto to form the ski.

One commonly encountered problem with utilizing a viscoelastic layer to dampen ski vibrations stems from the inherent lack of structural integrity of viscoelastic materials. The viscoelastic layer is usually the weakest portion of a ski. As discussed in the prior art section of this application, to minimize the reduction in ski strength caused by the use of a viscoelastic layer in prior skis it has been found necessary to limit the viscoelastic layer to a width substantially narrower than the width of the core of the ski.

Applicant has found that constructing a ski with a cured fiberglass box member surrounding a central core improves the strength and durability of the ski, but also results in a more vibration prone ski that a ski constructed without such a box member. However, applicant's use of box member 24 to surround core 22 when combined with a viscoelastic layer 42 extending the full width of the core 20 has unexpectedly resulted in a ski exhibiting greater than normal vibration damping. Combining together what would seem to be the worst structural combinations, a structural weak viscoelastic layer extending the full width of core 22 together with the highly vibration prone box member 42, results in a ski having surprisingly superior vibration damping characteristics.

As discussed above, placing viscoelastic layer 42 at neutral axis NA results in the maximum damping of high frequency ski vibrations. Another advantage of placing viscoelastic layer 42 at neutral axis NA stems from the fact that the closer the fibers of the materials from which ski 20 is constructed are located to neutral axis NA, the less the fibers are stretched or compressed during flexing of ski 20. Thus, since the upper and lower constraining layers 44 and 46 are placed adjacent neutral axis NA, such layers 44 and 46 can effectively transmit the shear stress occuring in ski 20 to the viscoelastic layer 42 without such layers themselves being stretched or compressed to the extent that the stiffness of said ski is appreciably increased. Also by forming them from the same resin used to formulate core layers 48 and 50, constraining layers 44 and 46 do not add any significant weight to ski 20. In effect the constraining layers serve their function without compromising the "liveliness" of ski 20.

Figure 6:
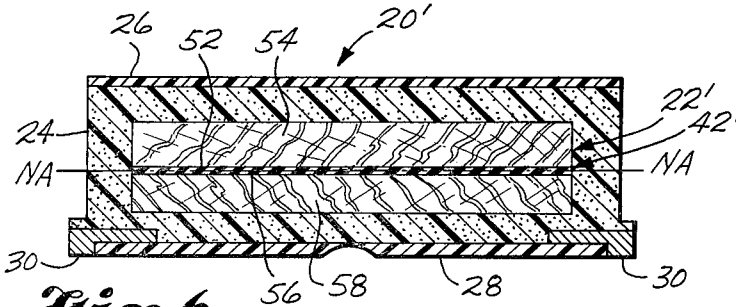

FIG. 6 illustrates another embodiment of the present invention involving an alternative construction of the ski 20 shown in FIGS. 1–5. With the exception of the construction of core 22', the ski 20' shown in FIG. 6 is essentially identical to the ski shown in FIGS. 1–5. Specifically, the same box member 24, top layer 26, bottom layer 28, and edges 30 are utilized. Core 22', however, is constructed with a viscoelastic layer 42' which has been bonded directly to the lower surface 52 of core upper layer 54 and to the upper surface 56 of core lower layer 58. Preferably viscoelastic layer 42' is the same type of material used to form viscoelastic layer 42. Additionally, core upper layer 54 and lower layer 58 are preferably formed from wood. In a manner similar to the construction of core 22 discussed above, upper and lower core layers 54 and 58 are milled to predetermined profile shapes to thus position viscoelastic layer 42' at the neutral axis NA along the entire length of the ski core 20'. Other than the manner of constructing core 22', the method of manufacturing ski 20' is substantially identical to that used to manufacture ski 20. Thus, it can be appreciated that ski 20' also possesses the important advantage of being able to efficiently and effectively dampen high frequency vibrations occuring during normal use.

It is to be understood the increased vibration damping through the use of viscoelastic layer 42 or 42' at the neutral axis of a ski is not limited to skis having cores constructed from only foamed plastic or wood. The core of the ski can be constructed from many other materials and still exhibit improved vibration damping through the use of viscoelastic layer 42 at the neutral axis of the ski.

The invention may be embodied in other specific forms without departing from the spirit or central characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

What is claimed is:

1. In a ski having a top surface and a bottom surface, the improvement comprising a vibration damping core disposed between the top and bottom surfaces, said core including a thin layer of viscoelastic material fixedly positioned at the neutral axis of the ski at every point along the length of said core, wherein:

said core includes an upper constraining layer of high modulus of elasticity material which is bonded to the upper surface of said layer of viscoelastic material; and a lower constraining layer of high modulus of elasticity material which is bonded to the lower surface of said layer of visoelastic material; and said core further includes an upper core layer of lightweight, low modulus of elasticity material disposed above said upper constraining layer of rigid material; and a lower core layer of lightweight, low modulus of elasticity material disposed below said lower constraining layer of rigid material.

2. The improvement according to claim 1, wherein said upper and lower core layers are formed from foamed resin material, and said upper and lower constraining layers are formed from the unfoamed resin utilized in said upper and lower core layers.

3. The improvement according to claim 1, further including a hollow box member encircling said core, said box member being composed of high modulus of elasticity material and including an upper wall disposed between the top surface of said ski and said core, a lower wall disposed between said core and the bottom surface of said ski, and side walls disposed adjacent the side walls of said core.

4. In combination with a ski having an exposed top surface and a ground contacting bottom surface, the improvement comprising:

a hollow box structure constructed from high modulus of elasticity material and disposed between the top and bottom surfaces;

a core having its top, bottom and side surfaces overlaid by said box structure, said core including a layer of viscoelastic material fixedly positioned at the neutral axis of the ski at every point along the length of said core;

wherein said core includes an upper constraining layer of high modulus of elasticity material disposed above the upper surface of said viscoelastic material and a lower constraining layer of high modulus of elasticity material disposed below the lower surface of said viscoelastic material to form a vibration damping laminate; and wherein said core includes an upper core layer of lightweight, low modulus of elasticity material disposed above said vibration damping laminate; and a lower core layer of lightweight, low modulus of elasticity material disposed below said vibration damping laminate; and a lower core layer of lightweight, low modulus of elasticity material disposed below said vibration damping laminate.

5. The combination according to claim 4, wherein said upper core layer, said vibration damping laminate and said lower core layer, are all of substantially the same width and length.

6. The combination according to claim 4, wherein said upper and lower core layers are formed from foamed resin plastic material, and said upper and lower constraining layers of said laminate are formed from the unfoamed resin used in said upper and lower core layers.

* * * * *

UNITED STATES PATENT OFFICE

CERTIFICATE OF CORRECTION

Patent No. 4,293,142 Dated October 6, 1981

Inventor(s) ALAN J. DAVIGNON

It is certified that error appears in the above-identified patent and that said Letters Patent are hereby corrected as shown below:

Col. 1, line 22, after "ski" insert -- is -- .

Col. 4, line 25, change "sanwhiched" to -- sandwiched -- .

Col. 4, line 53, "42", second occurrence, to -- 22 --.

Col. 6, line 30, change "as" to -- at -- .

Col. 8, line 4, change "that" to -- than -- .

Col. 9, line 22, change "visoelastic" to -- viscoelastic -- .

Signed and Sealed this

*Twenty-second* Day of *December 1981*

[SEAL]

*Attest:*

GERALD J. MOSSINGHOFF

*Attesting Officer* *Commissioner of Patents and Trademarks*